US010399750B1

(12) United States Patent
Latour et al.

(10) Patent No.: US 10,399,750 B1
(45) Date of Patent: Sep. 3, 2019

(54) SQUEEZABLE CONTAINER

(71) Applicant: Chobani, LLC, Norwich, NY (US)

(72) Inventors: Jean-Yves Latour, Utica, NY (US); Niel Sandfort, Warwick, NY (US); Christopher Ryan, Fairfield, CT (US); Sarah Maurer, New York, NY (US)

(73) Assignee: Chobani, LLC, Norwich, NY (US)

( * ) Notice: Subject to any disclaimer, the term of this patent is extended or adjusted under 35 U.S.C. 154(b) by 0 days.

(21) Appl. No.: 15/985,245

(22) Filed: May 21, 2018

(51) Int. Cl.
*B65D 47/20* (2006.01)
*B65D 75/00* (2006.01)
*B65D 75/58* (2006.01)

(52) U.S. Cl.
CPC ..... *B65D 47/2031* (2013.01); *B65D 75/008* (2013.01); *B65D 75/5877* (2013.01); *B65D 2547/066* (2013.01); *B65D 2575/583* (2013.01)

(58) Field of Classification Search
CPC ..... B65D 47/2031; B65D 75/008; B65D 75/5877; B65D 2547/066; B65D 2575/583
See application file for complete search history.

(56) References Cited

U.S. PATENT DOCUMENTS 4,017,020 A 4/1977 Frank
4,378,069 A 3/1983 Franco
5,271,531 A 12/1993 Rohr et al.
5,307,955 A * 5/1994 Viegas ..... B65D 47/2031 222/107
5,373,965 A 12/1994 Halm et al.
5,439,143 A 8/1995 Brown et al.
6,050,451 A 4/2000 Hess, III et al.
6,186,374 B1 2/2001 Gross
6,273,296 B1 8/2001 Brown
6,892,906 B2 5/2005 Py et al.
7,055,720 B1 6/2006 Pritchard
7,357,276 B2 4/2008 Savage et al.
7,373,959 B2 5/2008 Edwards et al.
7,731,066 B2 6/2010 Norris et al.
8,016,162 B2 9/2011 Cleary et al.
8,844,767 B1 9/2014 Bates et al.
8,960,502 B2 2/2015 Stehli, Jr. et al.
9,586,740 B2 * 3/2017 James ..... B65D 75/008
9,598,209 B1 3/2017 Maldonado
9,694,944 B2 7/2017 Long et al.
9,850,046 B2 * 12/2017 Stanley ..... B65D 75/008
(Continued)

OTHER PUBLICATIONS

"FIFO (First in, First Out) Bottle—cleaner, faster, better sauce dispenser," FifoBottle.com, 1 page (2006).
(Continued)

*Primary Examiner* — Frederick C Nicolas
(74) *Attorney, Agent, or Firm* — Foley Hoag LLP; Rajesh Vallabh

(57) ABSTRACT

A squeezable container is disclosed for holding and dispensing a flowable product like yogurt. The container generally includes a flexible and collapsible pouch body having an internal space for storing the flowable product, an external spout fitment attached to the outside of the dispensing end of the pouch body and through which the product can be dispensed, and a cap on the spout fitment, which can be opened by the user to dispense the product and closed to reseal the container. The cap includes a self-closing valve, and is configured to support the container in a cap-down orientation.

20 Claims, 3 Drawing Sheets

(56) References Cited

U.S. PATENT DOCUMENTS

| | | | | |
|---|---|---|---|---|
| 10,071,837 | B2 * | 9/2018 | Franca | B65D 47/2031 |
| 10,081,486 | B2 * | 9/2018 | Murray | B65D 85/72 |
| 10,196,192 | B2 * | 2/2019 | Gum | B65D 75/008 |
| 2006/0062497 | A1 | 3/2006 | Murray | |
| 2009/0028470 | A1 | 1/2009 | Murray | |
| 2012/0080450 | A1 | 4/2012 | Dziersk et al. | |
| 2015/0030264 | A1 * | 1/2015 | Murray | B65D 75/008 383/105 |
| 2016/0023819 | A1 | 1/2016 | Maldonado | |
| 2018/0360415 | A1 * | 12/2018 | Dohm | A61B 8/4281 |

OTHER PUBLICATIONS

"Heinz, Hunt's turn ketchup upside-down," Packaging World, pp. 1-6 (2002).
"Subway Condiment Bottles," RoadFood.com Discussion Board, pp. 1-4 (2011).
Drang, "Condiment container engineering," All This, pp. 1-5 (2011).

* cited by examiner

SQUEEZABLE CONTAINER

BACKGROUND

The present application relates generally to squeezable containers for holding and dispensing flowable products, including food products like yogurts and other dairy products.

BRIEF SUMMARY OF THE DISCLOSURE

Various embodiments disclosed herein relate to squeezable containers for holding and dispensing a flowable product, particularly yogurt products. The container includes a collapsible pouch, an external spout fitment on the pouch, and a cap removably secured to the spout fitment.

The collapsible pouch has an internal space for storing the flowable product. The pouch has a first dispensing end and an opposite second end. The pouch comprises a plurality of flexible sheet panels each sealed to another panel at edges thereof. The panels include a lower gusset panel at the first dispensing end of the pouch and an upper gusset panel at the opposite second end of the pouch. The lower gusset panel includes an opening leading to the internal space in the pouch.

The external spout fitment comprises a spout and a flange base extending around one end of the spout. The flange base is bonded to an outer surface of the lower gusset panel such that the spout is in fluid communication with the internal space of the pouch through the opening in the lower gusset panel.

The cap is removably secured to the spout. The cap includes a dispensing orifice with a self-closing valve therein and a lid removably covering the dispensing orifice. The lid has an outer surface configured to support the container in a cap-down orientation for storage.

The pouch is configured to be squeezed by a user to force the flowable product from the internal space in the pouch through the spout and the self-closing valve to dispense the product.

BRIEF DESCRIPTION OF THE DRAWINGS

Like or identical reference numbers are used to identify common or similar elements.

DETAILED DESCRIPTION

Figure 1:
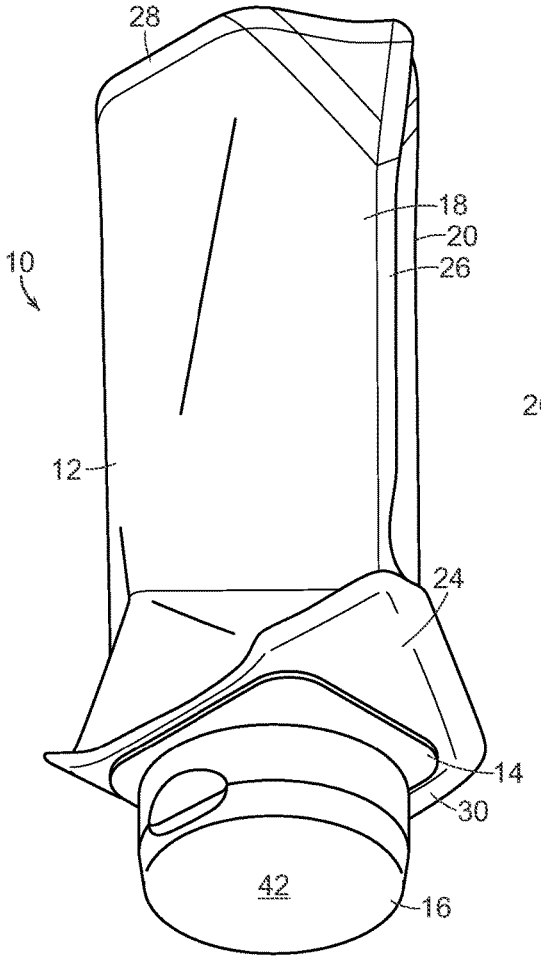
FIG. 1 is a perspective view of an exemplary squeezable container in accordance with one or more embodiments.
Figure 2:
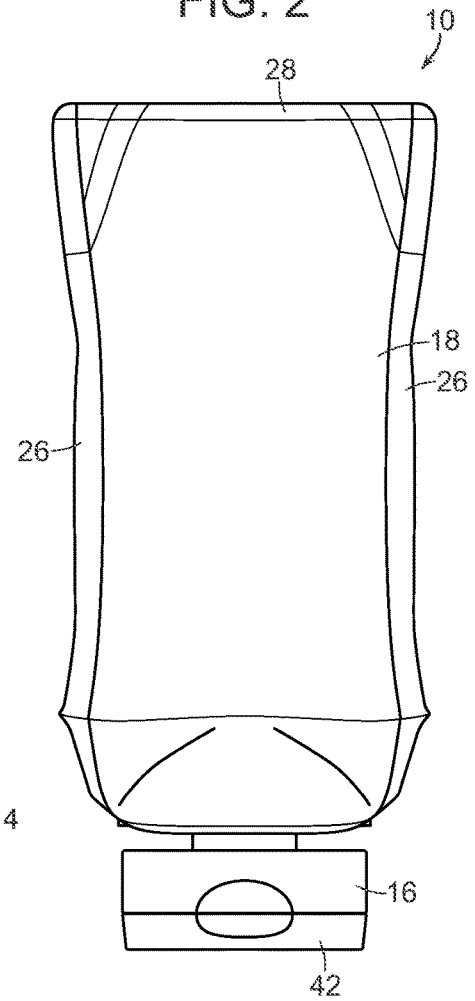
FIG. 2 is a front view of the container.
Figure 4:
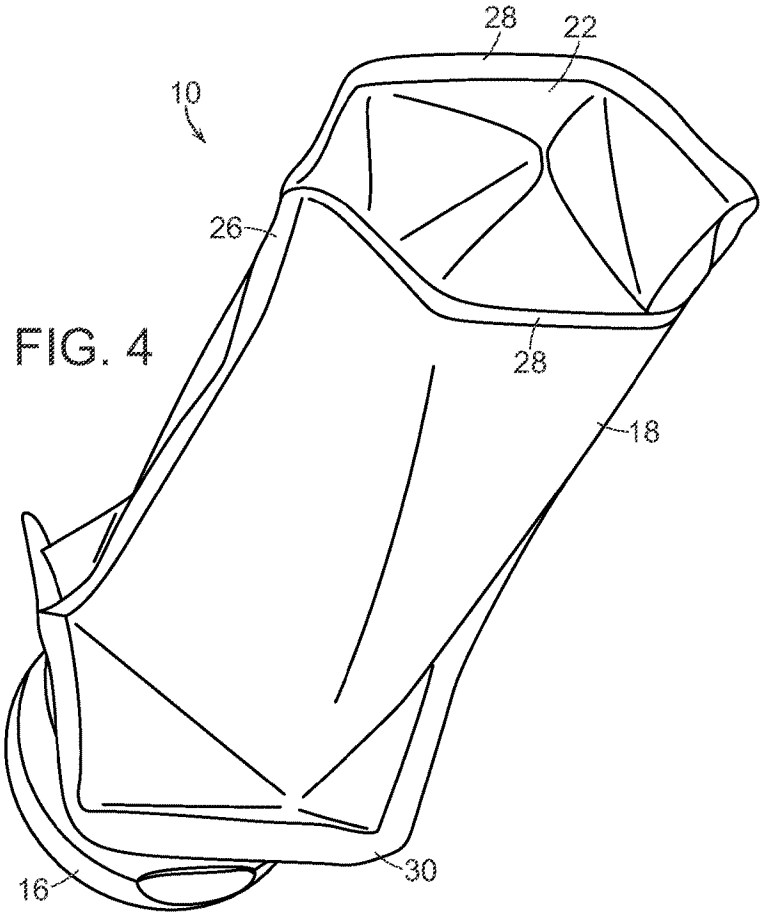
FIG. 4 is perspective view of the container showing the non-dispensing end of the container pouch.
Figure 3:
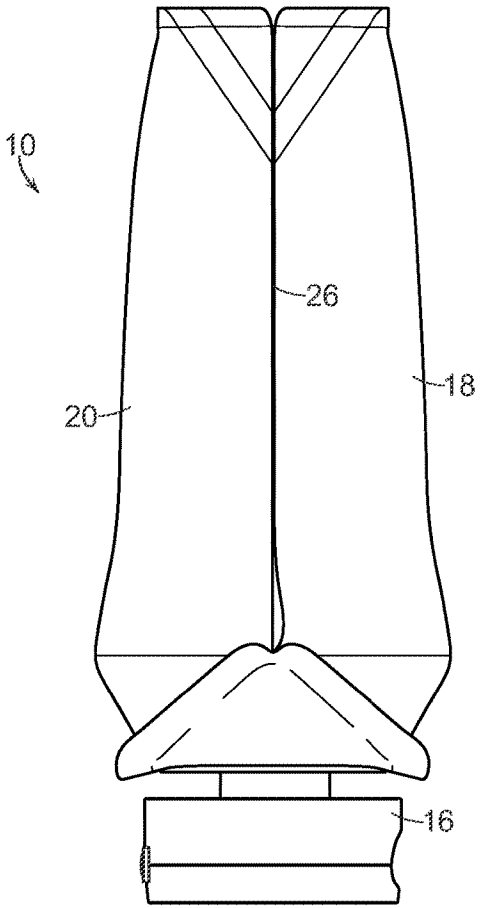
FIG. 3 is a side view of the container.
Figure 5:
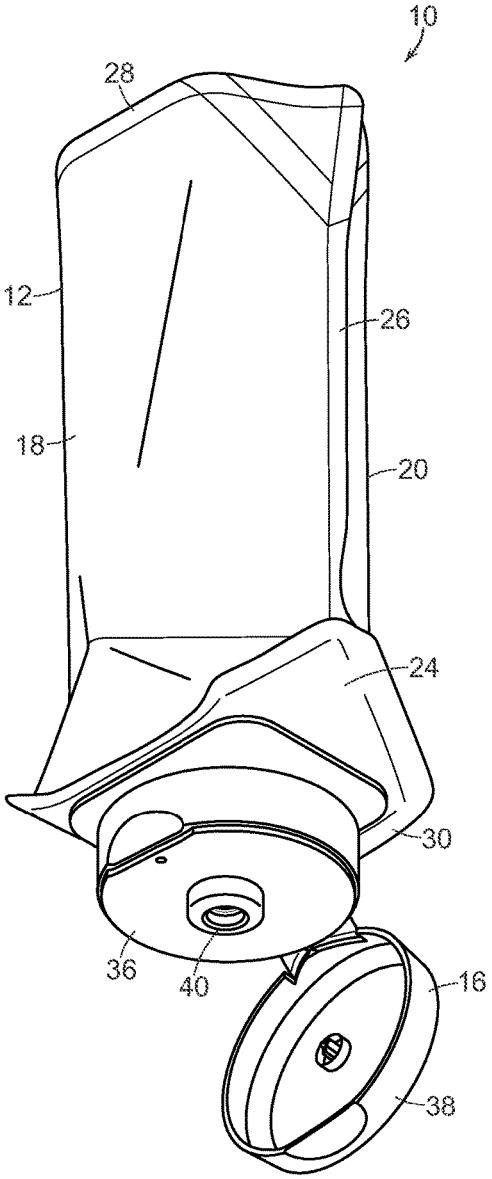
FIG. 5 is a perspective view of the container with the lid of the container cap in an opened position.
Figure 6:
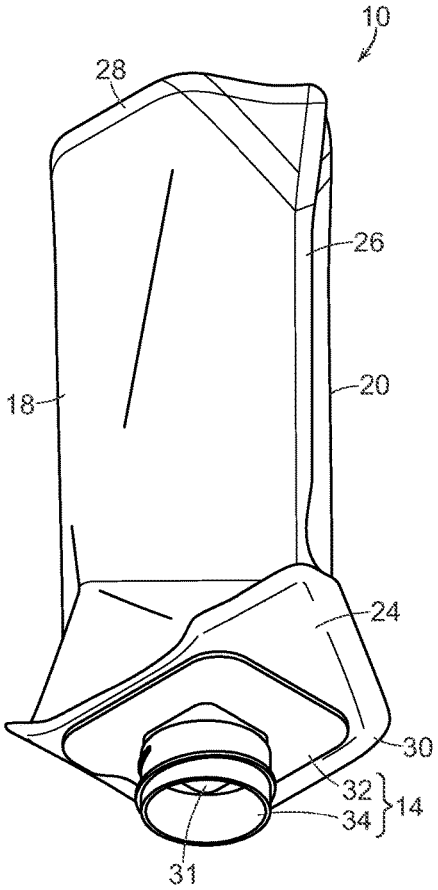
FIG. 6 is a perspective view of the container with the cap removed from the spout fitment.

Various embodiments disclosed herein relate to squeezable containers for holding and dispensing flowable products. In one or more exemplary embodiments, the squeezable containers are designed for storing food products, particularly yogurts and other dairy products. It should be understood, however, that containers in accordance with various embodiments can be used with virtually any type of flowable product, including both food and non-food products.

FIGS. 1-6 illustrate an exemplary squeezable container 10 in accordance with one or more embodiments. It should also be understood that the containers illustrated in the drawings are exemplary and many variations of such containers are possible. The particular size and shape of the illustrated containers are exemplary and not intended to be limiting.

The container 10 generally comprises a flexible and collapsible pouch body 12 having an internal space for storing the flowable product, a spout fitment 14 attached to the outside of the dispensing end of the pouch body 12 and through which the product can be dispensed, and a cap 16 on the spout fitment 14, which can be opened by the user to dispense the product and closed to reseal the container 10.

In one or more embodiments, the flexible pouch body 12 comprises a plurality of panels that are sealed at their outer edges to form the pouch and define the internal space for storing the product. The panels can comprise a variety of flexible sheet materials including, e.g., paper, plastic, and foil materials. The panels can also comprise a single layer or multiple layers including a multilayer laminate structure. The panels are liquid proof and can be bonded, e.g., by heat or ultrasonic sealing or welding processes.

In the illustrated exemplary embodiments, the flexible pouch body 12 comprises a front panel 18, a back panel 20, an upper gusset panel 22, and a lower gusset panel 24. The front and back panels 18, 20 are sealed to each other along their outer edges, forming side seal lines 26. The upper edges of the front and back panels 18, 20 are sealed to the outer edge of the upper gusset panel 22 at upper seal lines 28. Similarly, the lower edges of the front and back panels 18, 20 are sealed to the outer edge of the lower gusset panel 24 at lower seal line 30.

In accordance with one or more embodiments, some or all of the panels 18-24 are integrally connected end-to-end and are formed from a single sheet of flexible material. The single sheet of material can be folded and sealed at the folds to form the pouch. In one or more alternate embodiments, the panels 18-24 can comprise separate sheets of material that are joined to other sheets at their outer edges to form the pouch.

The lower gusset panel 24 includes a slit or opening 31 at the center thereof leading to the internal space in the flexible pouch body 12. The spout fitment 14 is secured to the exterior surface of the lower gusset panel 24 such that the spout 34 of the fitment is in fluid communication with the interior of the flexible pouch body 12 through the opening in the lower gusset panel 24. The product in the pouch body 12 can thereby be dispensed through the spout fitment 14.

The spout fitment 14 comprises a flange base 32 and a spout 34 that extends in a generally perpendicular direction from the flange base 32. Helical threads extend about the outer surface of the spout 34. The threads are configured to engage corresponding interior threads of the cap 16. When the container 10 is used for storing food products, the spout fitment 14 preferably comprises a food grade plastic. The spout fitment 14 can be made by injection molding or other processes.

The surface of the flange base 32 opposite the spout 34 is securely bonded to the lower gusset panel 24 of the pouch body 12. In one or more embodiments, the flange base 32 is heat sealed or ultrasonically welded to the pouch body 12. In the exemplary embodiments, the flange base 32 is bonded to the outside surface of the lower gusset of the pouch body 12, and the spout fitment is external, i.e., no portion of the spout fitment 14 is inside the pouch body 12. This particular arrangement of components advantageously simplifies construction of the container 10.

The cap 16 has a screw cap base 36 with a hinged flip-top lid 38 in accordance with one or more embodiments. The screw cap base 36 is screwed onto the threaded spout 34 of the spout fitment 14. The flip-top lid 38 can be flipped open relative to the base 36 to the opened position shown in FIG. 5 when a consumer wants to dispense the product. In the opened position, a dispensing orifice 40 in the cap base 36 is uncovered, through which the product is dispensed. The flip-top lid 38 can be snapped into the closed position shown in FIGS. 1-4, when desired, enabling the user to quickly and easily reseal the container 10 as needed. The cap 16, like the spout fitment 14, can be a molded plastic component, and may be a food-grade material if the product is a food product.

The cap lid 38 includes a wide flat outer surface 42, which supports the container 10 in a cap-down position when stored on a surface (e.g., a refrigerator shelf) in a stable manner.

Figure 7:
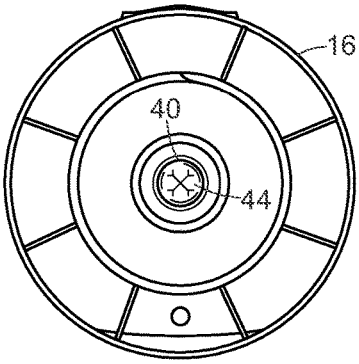
FIG. 7 is an inside view of the cap showing the self-closing valve in the cap base.

As shown in FIG. 7, which is a bottom view of the cap base 36, the dispensing orifice 40 includes a self-closing valve 44 therein, which inhibits unwanted product leakage. The valve comprises a resilient membrane (e.g., a silicone membrane) with slits. The valve is biased toward a closed position. When the container 10 is squeezed, pressure applied by the product causes the membrane to separate at the slits, thereby creating an opening through which the product can be dispensed. When the user stops squeezing the container 10, the membrane resiliently reverts to its closed position, inhibiting further product flow. The valve 44 thereby allows a more controlled product delivery with reduced or no dripping, and also reduces or prevents leakage when the container 10 is stored in the cap-down orientation.

The valve 44 also inhibits entry of air into the interior space in the pouch body 12. As discussed above, the pouch body 12 is collapsible. As the user squeezes the container 10 to dispense the product, the pouch body 12 collapses and is reduced in volume. The valve closes when the user stops squeezing the container 10 and helps keep air from entering the container 10. By limiting exposure to air, the product shelf life can be increased.

The combination of features of the container 10 described above have been found to be particularly advantageous for use in storing and dispensing yogurt products. For instance, the configuration of the container designed to be stored in a cap-down position is particularly advantageous for yogurt products where there may be whey separation from the yogurt. Any separated whey will collect at the upper, non-dispensing end of the container 10. Therefore, when the user dispenses the product from the opposite dispensing end, the separated whey will not (at least initially) be dispensed, which may be undesirable for some users.

In addition, the use of the upper and lower gusset panels 22, 24 in the container enables the pouch body 12 to have an expanded generally tubular shape as it can be filled substantially throughout the pouch, including at the dispensing and non-dispensing ends. This allows for more complete and efficient space utilization during transportation as well as when stored on shelves.

Furthermore, the use of an external spout fitment bonded only to the outside of the pouch simplifies the construction of the container. In addition, it provides a clean, aesthetically pleasing appearance.

A premade container 10 can be filled with a product using commercially available pouch filling equipment. The cap 16 of the container 10 is removed from the spout fitment 14. A filling nozzle of the pouch filling equipment is inserted into the spout fitment 14, and a fixed volume of product is deposited into the pouch through the spout 34. A removable seal or liner such as a tamper-evident liner can be applied to the end of the spout 34 to seal the pouch. The cap 16 is then twisted into place on the spout fitment 14. After purchasing the product-filled container, the user removes the cap 16 and peels off the seal or liner before reinstalling the cap and dispensing the product.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

The invention claimed is:

1. A squeezable container for holding and dispensing a flowable product, comprising:

a collapsible pouch having an internal space for storing the flowable product, the pouch having a first dispensing end and an opposite second end, the pouch comprising a plurality of flexible sheet panels each sealed to another panel at edges thereof, the panels including a lower gusset panel at the first dispensing end of the pouch and an upper gusset panel at the opposite second end of the pouch, the lower gusset panel including an opening leading to the internal space;

an external spout fitment comprising a spout and a flange base extending around one end of the spout, the flange base being bonded to an outer surface of the lower gusset panel such that the spout is in fluid communication with the internal space of the pouch through the opening in the lower gusset panel; and a cap removably secured to the spout, the cap including a dispensing orifice with a self-closing valve therein and a lid removably covering the dispensing orifice, the lid having an outer surface configured to support the container in a cap-down orientation for storage;

wherein the pouch is configured to be squeezed by a user to force the flowable product from the internal space in the pouch through the spout and the self-closing valve to dispense the product.

2. The container of claim 1, wherein the flowable product is a yogurt product.

3. The container of claim 1, wherein an exterior surface of the spout is threaded, and wherein the cap comprises a screw cap base adapted to be twisted on the spout and a hinged flip-top lid.

4. The container of claim 1, wherein the valve comprises a resilient membrane having one or more slits therein, and the valve is biased toward a closed position.

5. The container of claim 1, wherein the external spout fitment is attached to the lower gusset panel by ultrasonic welding.

6. The container of claim 1, wherein the flexible sheet panels comprise one or more paper, plastic, or foil materials.

7. The container of claim 1, wherein the cap and the spout fitment comprise molded plastic components.

8. The container of claim 1, wherein the collapsible pouch has a generally tubular shape when filled with the product.

9. A squeezable container holding a yogurt product, comprising:

a yogurt product;

a collapsible pouch having an internal space storing the yogurt product, the pouch having a first dispensing end and an opposite second end, the pouch comprising a plurality of flexible sheet panels each sealed to another panel at edges thereof, the panels including a lower gusset panel at the first dispensing end of the pouch and an upper gusset panel at the opposite second end of the pouch, the lower gusset panel including an opening leading to the internal space;

an external spout fitment comprising a spout and a flange base extending around one end of the spout, the flange base being bonded to an outer surface of the lower gusset panel such that the spout is in fluid communication with the internal space of the pouch through the opening in the lower gusset panel; and a cap removably secured to the spout, the cap including a dispensing orifice with a self-closing valve therein and a hinged flip-top lid removably covering the dispensing orifice, wherein the self-closing valve is biased toward a closed position, and the lid has an outer surface configured to support the container in a cap-down orientation for storage;

wherein the pouch is configured to be squeezed by a user to force the yogurt product from the internal space in the pouch through the spout and the self-closing valve to dispense the product.

10. The container of claim 9, wherein an exterior surface of the spout is threaded, and wherein the cap comprises a screw cap base adapted to be twisted on the spout.

11. The container of claim 9, wherein the valve comprises a resilient membrane having one or more slits therein, and the valve is biased toward a closed position.

12. The container of claim 9, wherein the external spout fitment is attached to the lower gusset panel by ultrasonic welding.

13. The container of claim 9, wherein the flexible sheet panels comprise one or more food grade paper, plastic, or foil materials.

14. The container of claim 9, wherein the cap and the spout fitment comprise food grade molded plastic components.

15. The container of claim 9, wherein the collapsible pouch has a generally tubular shape when filled with the product.

16. A squeezable yogurt container, comprising:

a yogurt product;

a collapsible pouch having an internal space in which the yogurt product is stored;

an external spout fitment comprising a spout and a flange base supporting the spout, the flange base being bonded to an outer surface of a dispensing end of the pouch such that the spout is in fluid communication with the internal space of the pouch through an opening in the dispensing end of the pouch, wherein an exterior surface of the spout is threaded; and a cap removably secured to the spout, said cap comprising a screw cap base adapted to be threadably connected to the spout and a flip-top lid hingedly connected to the screw cap base, the screw cap base including a dispensing orifice with a self-closing valve therein, the valve comprising a resilient membrane having one or more slits therein, wherein the valve is biased toward a closed position, and wherein the hinged flip-top lid removably covers the dispensing orifice and valve, and the lid has an outer surface configured to support the container in a cap-down orientation when positioned on a surface;

wherein the pouch is configured to be squeezed by a user to force the yogurt product from the internal space in the pouch through the spout and the self-closing valve to dispense the product.

17. The container of claim 16, wherein the pouch has an non-dispensing end opposite the dispensing end, and the pouch comprises a plurality of flexible sheet panels each sealed to another panel at edges thereof, the panels including a lower gusset panel at the dispensing end of the pouch and an upper gusset panel at the opposite non-dispensing end of the pouch, the lower gusset panel including the opening leading to the internal space.

18. The container of claim 17, wherein the flexible sheet panels comprise one or more paper, plastic, or foil materials.

19. The container of claim 16, wherein the cap and the spout fitment comprise molded plastic components.

20. The container of claim 16, wherein the collapsible pouch has a generally tubular shape when filled with the product.

* * * * *